US006205824B1

(12) United States Patent
Miao

(10) Patent No.: US 6,205,824 B1
(45) Date of Patent: Mar. 27, 2001

(54) LOCK WITH A FASTENING CABLE

(76) Inventor: Tony Miao, No. 486, Sec. 3, Ming Chih Rd., Tai Shan Hsiang, Taipei Hsien (TW)

( * ) Notice: Subject to any disclaimer, the term of this patent is extended or adjusted under 35 U.S.C. 154(b) by 0 days.

(21) Appl. No.: 09/494,754

(22) Filed: Jan. 31, 2000

(51) Int. Cl.[7] ..... E05B 60/00
(52) U.S. Cl. ..... 70/58; 70/14; 70/57; 248/551
(58) Field of Search ..... 70/14, 18, 19, 70/57, 58; 248/551–553; 361/681, 685, 686, 732

(56) References Cited

U.S. PATENT DOCUMENTS

| | | | | |
|---|---|---|---|---|
| 5,327,752 | * | 7/1994 | Meyers et al. | 70/58 |
| 5,687,592 | * | 11/1997 | Penniman et al. | 70/14 |
| 5,709,110 | * | 1/1998 | Greenfield et al. | 70/58 |
| 5,791,171 | * | 8/1998 | Kelley | 70/14 X |
| 5,875,657 | * | 3/1999 | Kelley | 70/18 |
| 5,907,962 | * | 6/1999 | Smithson et al. | 70/14 X |
| 5,913,907 | * | 6/1999 | Lee | 70/14 X |
| 5,983,679 | * | 11/1999 | Reyes | 70/14 X |
| 5,987,937 | * | 11/1999 | Lee | 70/14 |
| 6,000,252 | * | 12/1999 | Murray et al. | 70/18 X |
| 6,006,557 | * | 12/1999 | Carl et al. | 70/14 X |
| 6,038,891 | * | 3/2000 | Zeren et al. | 70/14 X |
| 6,058,744 | * | 5/2000 | Ling | 70/58 X |

* cited by examiner

*Primary Examiner*—Suzanne Dino Barrett
(74) *Attorney, Agent, or Firm*—Heller Ehrman White & McAuliffe LLP

(57) ABSTRACT

A lock with a fastening cable includes a locking unit with a cable having a passage defined in the locking unit and a key operated lock received in the passage. The key operated lock includes a circular transmission block with the key operated lock in contact with one side and two stubs extending from the other side. These two stubs are on opposite ends of a diameter of a face of the transmission block. A latch connects to the key operated lock. The latch includes a first locking plate and a second locking plate abutting each other. The first locking plate includes a first end having a first bracket extending out therefrom and is moved transversely by the stub, and a second end having a first engagement hook extending out therefrom. The first engagement hook and the first locking plate are in the same plane. The second locking plate includes a first end having a second bracket extending out therefrom and moved transversely by the stub, and a second end having a second engagement hook extending out therefrom. The second engagement hook and the second locking plate are in the same plane. The first bracket and the second bracket extend in opposite directions, and the first engagement hook and the second engagement hook also extend in opposite directions. The latch further includes a positioning plate to allow the first locking plate and the second locking plate to extend therethrough and a spring having a first end abutting the positioning plate a second end abutting a casing. The casing is mounted on the locking unit to receive the latch and the locking unit.

9 Claims, 10 Drawing Sheets

LOCK WITH A FASTENING CABLE

BACKGROUND OF THE INVENTION

1. Field of the Invention

The present invention relates to a lock and, more particularly, to a lock with a fastening cable for use in securing computer equipment such as a notebook computer, a scanner, a printer and other suitably adapted object.

2. Description of Related Art

The closest prior art of which the applicant is aware is disclosed in U.S. Pat. No. 5,791,171 to Donald W. Kelley, filed on Aug. 11, 1998, entitled "Scissor Lock with A Removable Cable Adapter".

Many different locking apparatuses have been developed to secure computer equipment. One such locking apparatus is the "Scissor Lock with A Removable Cable Adapter" which is disclosed in U.S. Pat. No. 5,791,171 to Donald W. Kelley. The "Scissor Lock with A Removable Cable Adapter" comprises a key operated scissor lock structure to operate two scissor arms. Each of the two scissor arms has a pivotal hole defined therein and aligned with each other. These two scissor arms each has an engagement end extending through a sleeve of the locking unit to engage in a computer or other suitable object. The engagement ends of the two scissor arms are hook-like structures each extending out from the scissor arms and being opposite to the other. The pivot assembly includes two clamps each having a through hole defined therein and a pin. The two clamps abut each other to form a housing into which the scissor arms are mounted by means of the pin.

Even though the locking unit can secure computer equipment or other suitable object, it has several disadvantages as follow.

1. The scissor arms are received and mounted in the housing of the pivot assembly, each of them has a hole to allow the pin to pass through. The scissor arms, the clamps and the pin are all small parts. It is hard for a worker to assembly these parts.

2. There is a certain distance between the engagement ends of the scissor arms and the sleeve of the locking unit, but the thickness of the casing of a computer varies. This locking unit will be useless when the thickness of the casing of a computer is bigger than the distance between the engagement ends of the scissor arms and the sleeve of the locking unit.

The present invention has arisen to mitigate and/or obviate the disadvantages of the conventional scissor lock.

SUMMARY OF THE INVENTION

In accordance with one aspect of the present invention, a lock with a fastening cable is provided. The lock is used to secure business equipment such as printers, notebook computers or other suitable objects. The lock comprises a locking unit with a cable attached thereto, a key operated lock received in the locking unit and a latch which is operated by the key operated lock and received in a casing. The latch includes a transmission block and a couple of locking plates. Each of the locking plates has an engagement hook extending out and passing through the casing to engage in a locking hole of the equipment. The lock is fastened to another object by the cable after engaging to the equipment.

Further benefits and advantages of the present invention will become apparent after a careful reading of the detailed description with appropriate reference to the accompanying drawings.

DETAILED DESCRIPTION OF THE INVENTION

Figure 1:
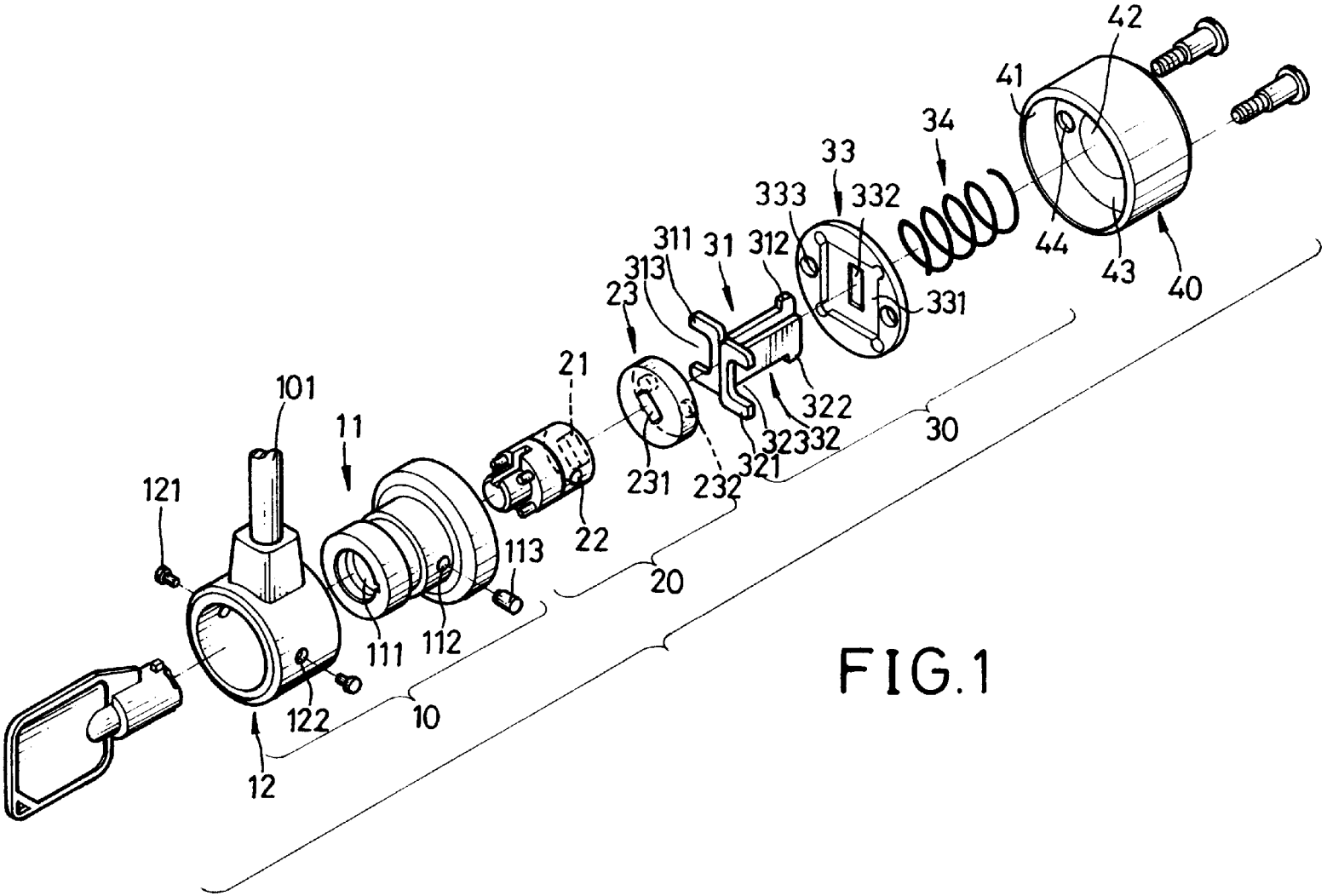
FIG. 1 is an exploded perspective view of a lock with a fastening cable in accordance with the present invention.
Figure 2:
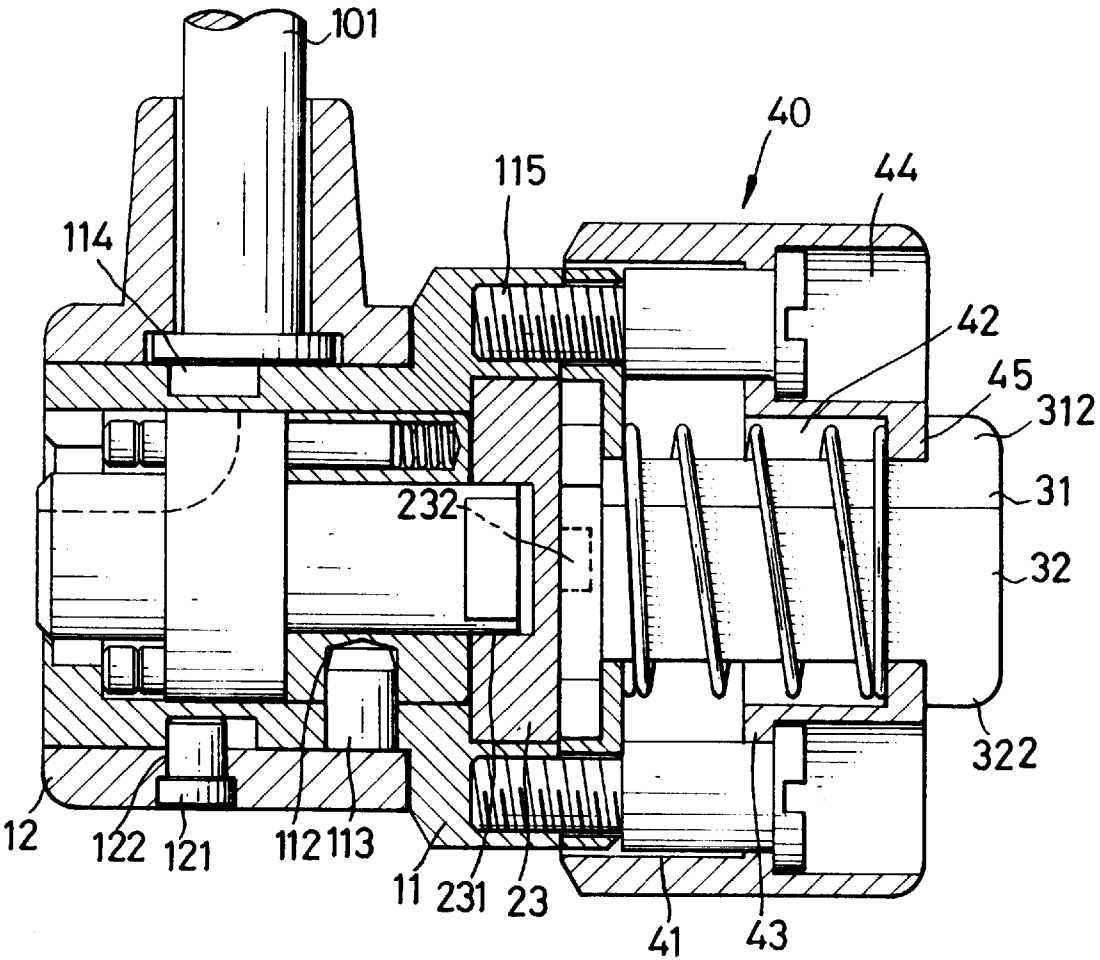
FIG. 2 is a cross-sectional side view of the lock with a fastening cable in FIG. 1.
Figure 3:
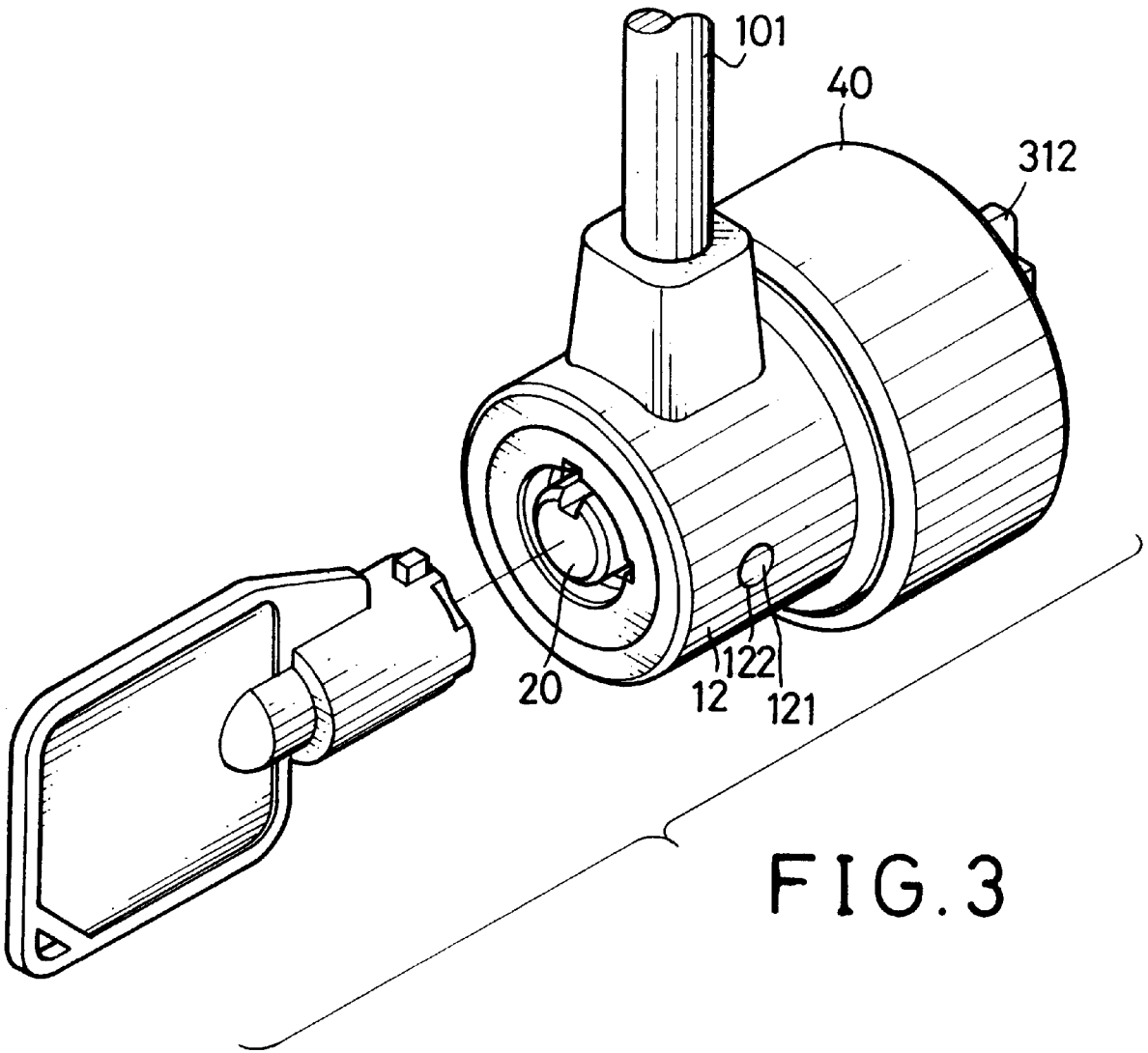
FIG. 3 is a perspective view of a lock with a fastening cable in FIG. 1.

Referring to the drawings and initially to FIGS. 1–2, a lock with a fastening cable in accordance with the present invention comprises a locking unit (10), a key operated lock (20), a latch (30) operated by the key operated lock (20) and a casing (40) covering all the parts.

The locking unit (10) includes a lock casing (11) and a cable adapter (12). The lock casing (11) has a passage (111) defined therein and a locking hole (112) communicating with the passage (111). The lock casing (11) further includes a annular groove (114) between the locking hole (112) and the small end and at least two threaded holes (115) defined in the face of the large end. The cable adapter (12) has a cable (101) attached thereto and at least one pinhole (122) aligning with the groove (114). The cable adapter (12) is mounted on the locking unit (10) by means of a pin (121) extending through each pinhole (122) and into the groove (114) of the locking unit (10).

The key operated lock (20) has an eccentric shaft (21) extending therefrom and a blind hole (22) defined therein and aligning with the locking hole (112) in the lock casing (11). The key operated lock (20) is received in the passage (111) of the locking casing (11) and held in place by a lock pin (113) penetrating the locking hole (112) and partially received in the blind hole (22). An eccentric recess (231) corresponding to the eccentric shaft (21) is defined in one side of a circular transmission block (23) and two stubs (232) extend from the opposite side. The two stubs (232) are defined on opposite ends of a diameter of the end face of the transmission block (23). The eccentric recess (231) in the transmission block (23) receives the eccentric shaft (21) extending from the lock (20).

The latch (30) includes a first locking plate (31) and a second locking plate (32) abutting each other. A first bracket (311) is defined on the first end of the first locking plate (31), and a first engagement hook (312) is defined on the second end. A second bracket (321) is defined on the first end of the second locking plate (32) and a second engagement hook (322) is defined on the second end. The first and second brackets (311; 321) respectively extend out from the first and second locking plates (31; 32) opposite to each other. Each of the first and second brackets (311; 321) has a recess defined therein to respectively receive one of the two stubs (232). The first and second engagement hooks (312; 322) respectively extend from the first and second locking plate (31; 32) opposite to each other. The first engagement hook (312) and the first locking plate (31) are on the same plane. The second engagement hook (322) and the second locking plate (32) are on the same plane. The latch (30) further includes a positioning plate (33) and a spring (34). One side of the positioning plate (33) has a recess (331) to allow the first and second brackets (311; 321) to move therein. At least two through holes (333) are defined in the positioning plate (33) and align with the threaded holes (115) in the end face of the lock casing (11). A slot (332) is formed at the center of the positioning plate (33) to allow the first and second locking plates (31; 32) to penetrate. One end of the spring (34) abuts the side of the positioning plate (33) opposite to the recess (331) and fits around the portion of the first and second locking plates (31; 32) that extend through the positioning plate (33).

Referring to FIG. 2, the casing (40) includes a cavity (41) defined therein to receive the locking unit (10) and latch (30). An inner flange (43) extends in from the casing (40) to form an opening (42) near the center of the casing (40). The inner flange (43) has at least two countersunk holes (44) defined therein to allow a bolt to extend therethrough. A flange (45) is formed around the outer end of the opening to abut and retain the end of the spring (34).

Figure 4:
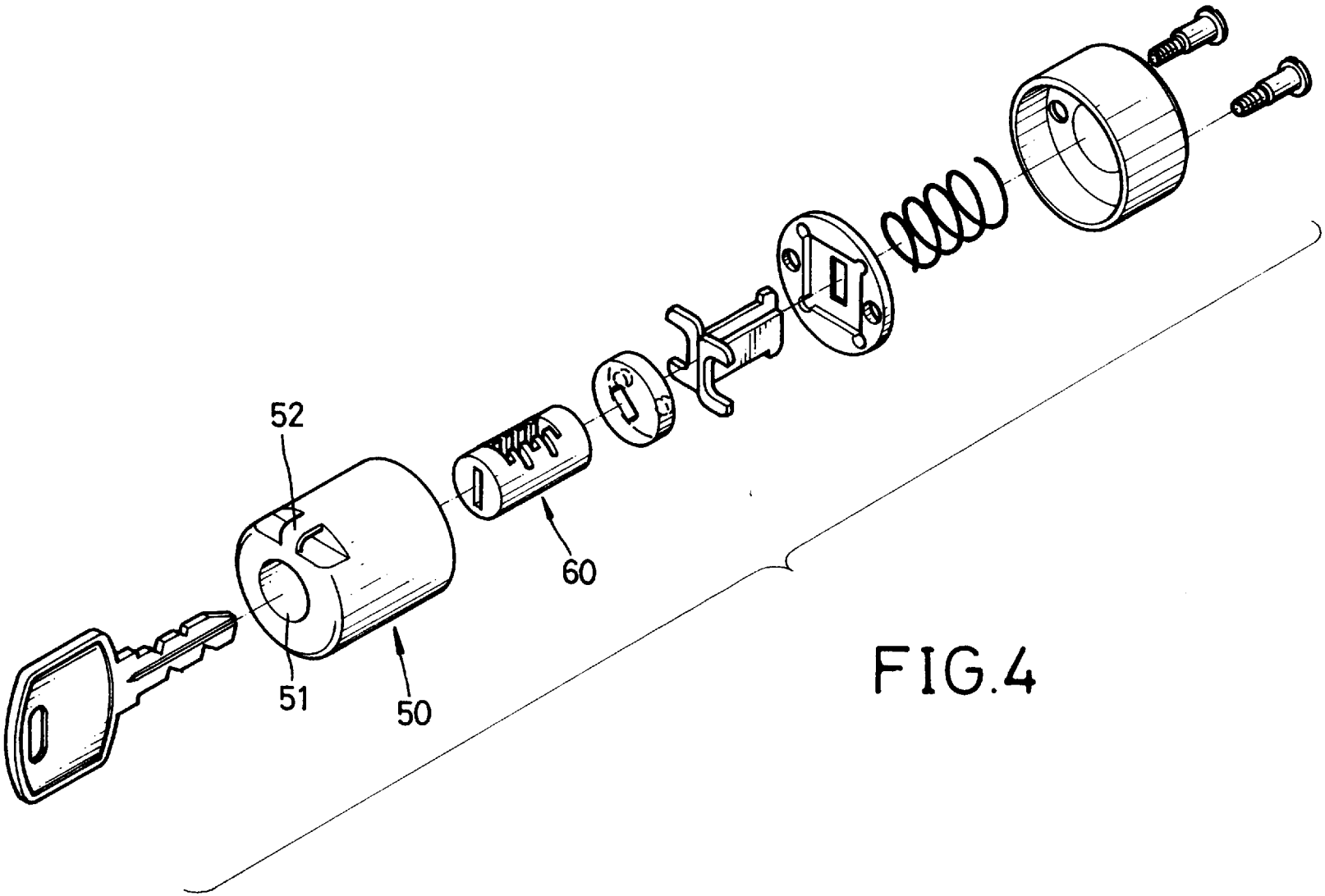
FIG. 4 is an exploded perspective view of second embodiment of a lock with a fastening cable in accordance with the present invention.

Referring to FIG. 4, a second embodiment of the present invention comprises a locking unit (50) having a passage (51) defined therein to receive a key operated lock therein and a hook portion (52) to allow a cable (101) to be attached thereto.

Figure 5:
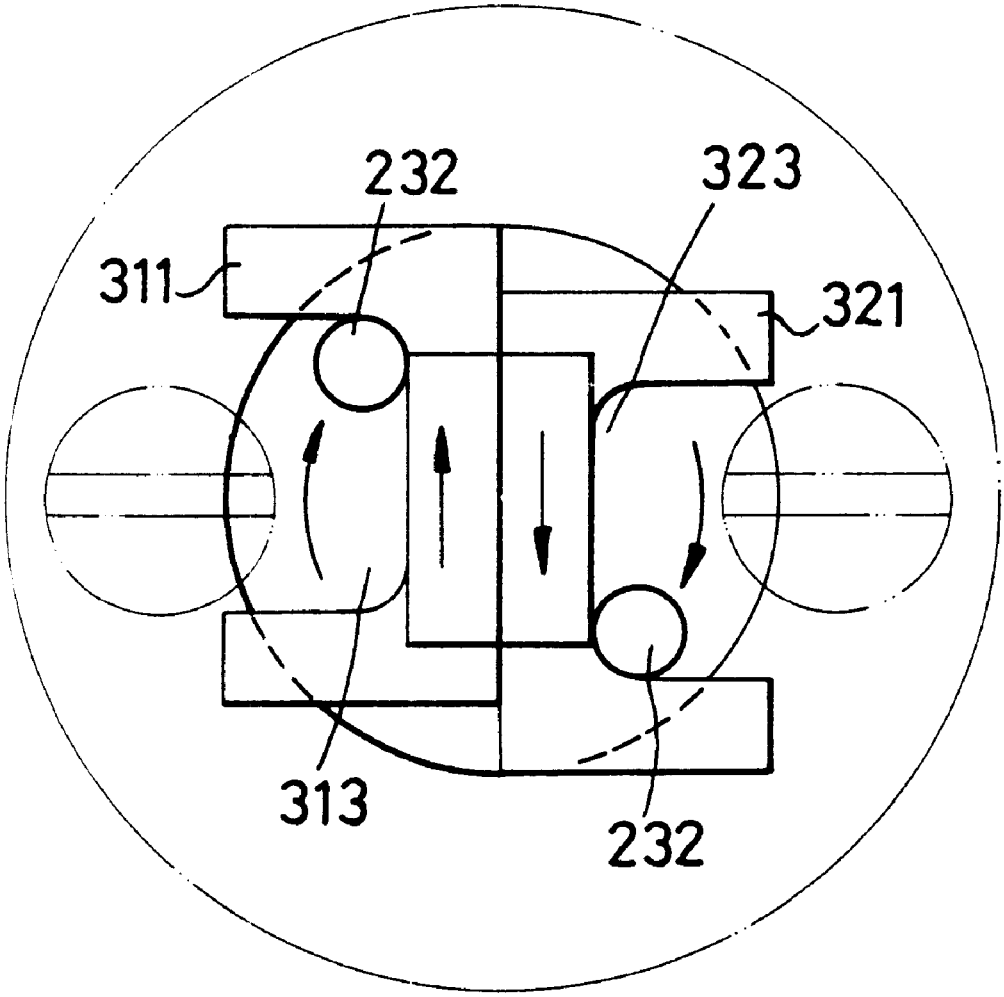
FIG. 5 illustrates the relationship of the stubs to the brackets when the present invention is locked.

Referring to FIG. 5, the two stubs (232) respectively push the first locking plate (31) up and the second locking plate (32) down to extend the hooks (312, 322) and lock the device when the key operated lock (20) is turned clockwise.

Figure 6:
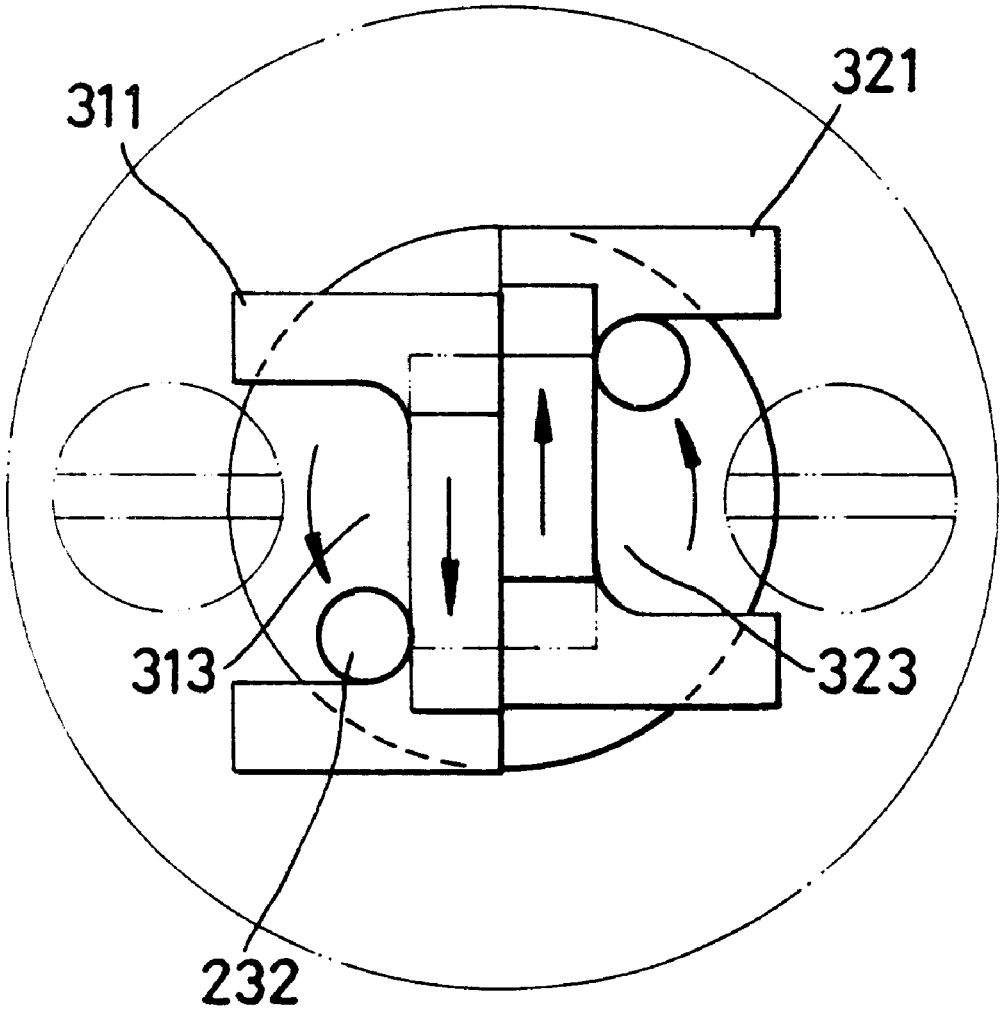
FIG. 6 illustrates the relationship of the stubs to the brackets when present invention is unlocked.

Referring to FIG. 6, the two stubs (232) respectively push the first locking plate (31) down and the second locking plate (32) up to retract the hooks (312, 322) and release the device when the key operated lock (20) is turned counter clockwise.

Figure 7:
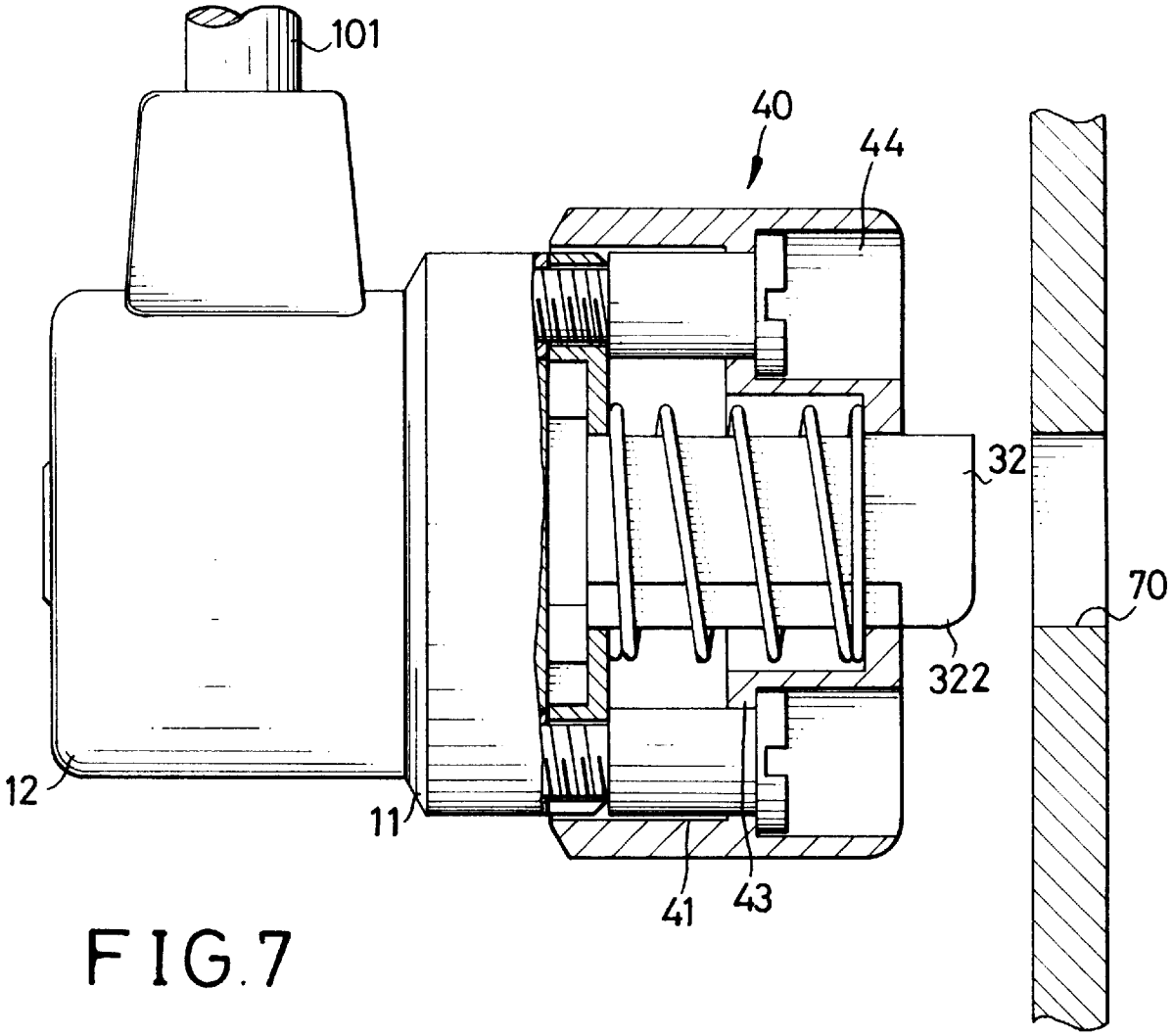
FIG. 7 is a side plan view in partial section of the lock with a fastening cable before locking.

Referring to FIG. 7, the key operated lock (20) is turned counterclockwise to retract the two engagement hooks (312; 322) so the engagement hooks (312; 322) easily extend through a locking hole (70) in a computer or other suitable object.

Figure 8:
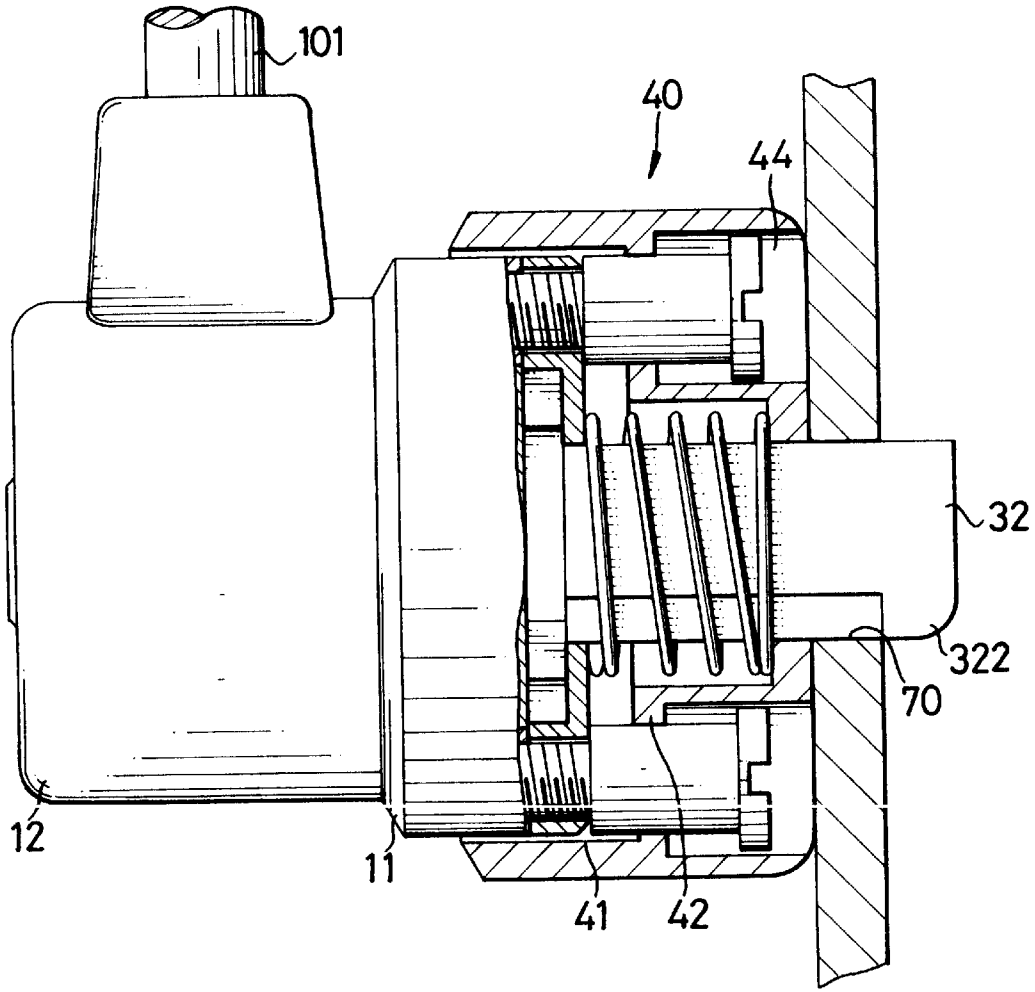
FIG. 8 is a side plan view in partial section of the lock with a fastening cable during locking.

Referring to FIG. 8, the casing (40) contacts the computer around the locking hole and compresses the spring (34) so that the first and second engagement hooks (312; 322) extend and pass through the locking hole (70) in the computer or other suitable object,.

Figure 9:
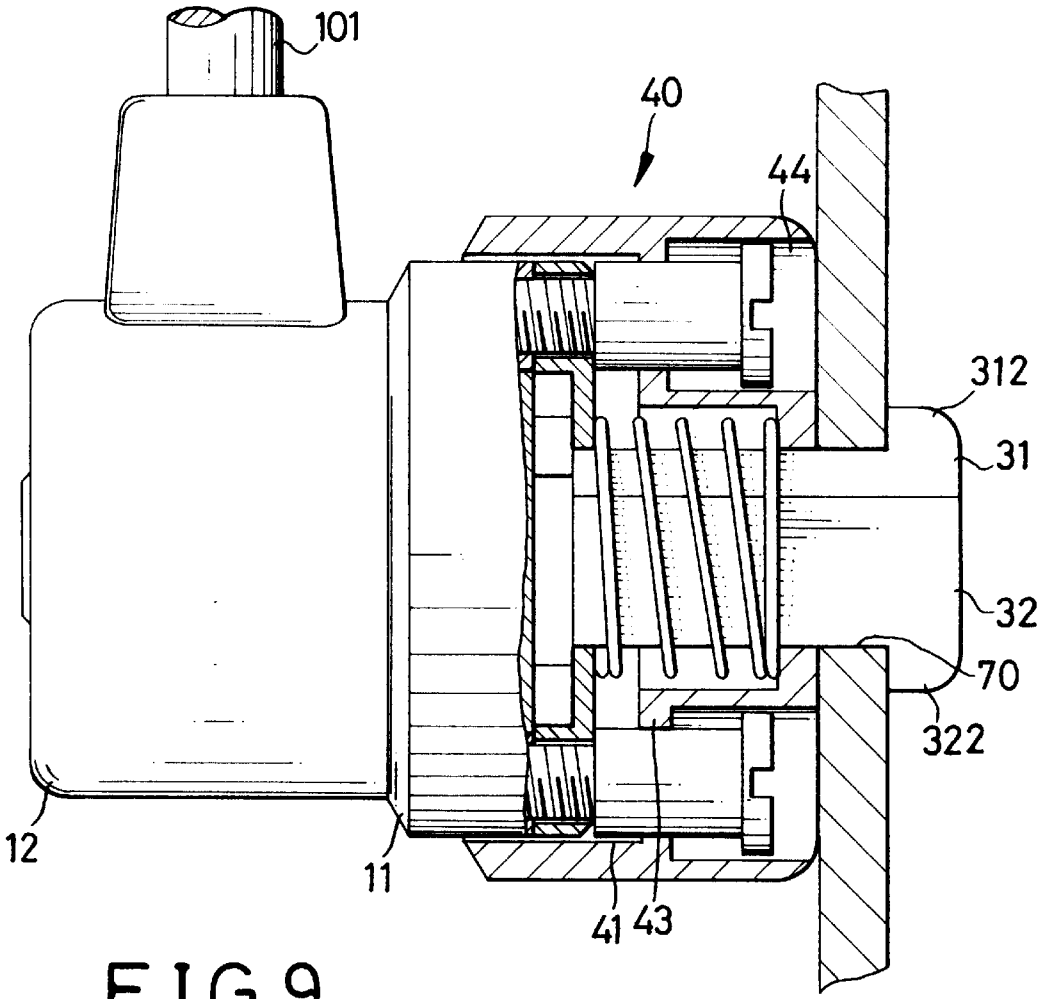
FIG. 9 is a side plan view in partial section of the lock with a fastening cable finish locking.

Referring to FIG. 9, the key operated lock (20) is turned clockwise to extend the two engagement hooks (312; 322) wider than the diameter of the locking hole (70) to engage the inside of the locking hole (70) when the casing (40) is released. Then the two engagement hooks (312; 322) and the casing (40) securely abut the locking hole (70) due to the resilient force of the spring (34).

Figure 10:
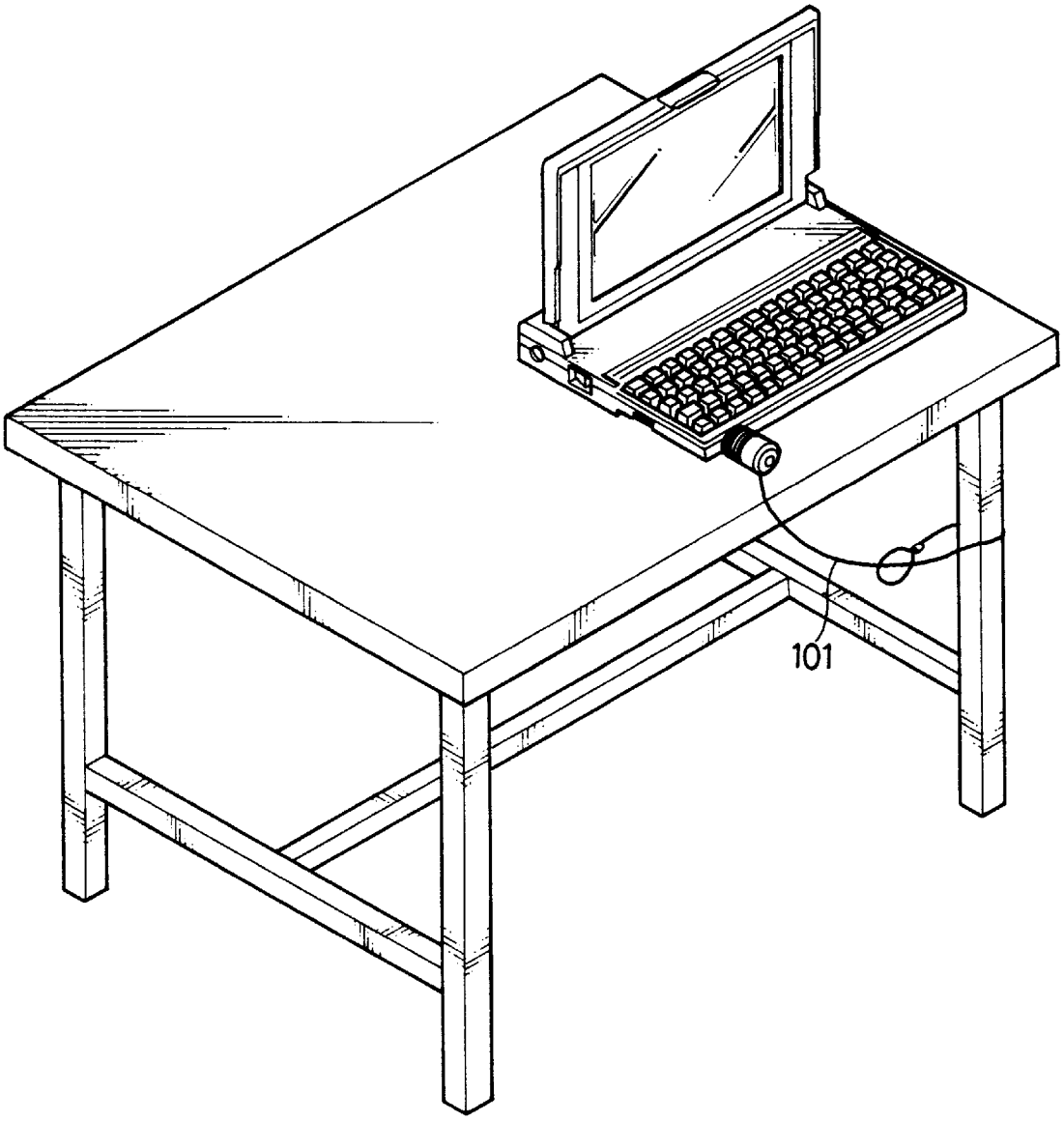
FIG. 10 is a schematic operational view of the lock with a fastening cable as shown in FIG. 1 in use.

Referring to FIG. 10, the cable (101) of the locking unit (10) is attached to another object such as a table or a chair, and the lock in accordance with the present invention is locked to a computer or other suitable object.

Although the invention has been explained in relation to its preferred embodiment, it is to be understood that many other possible modifications and variations can be made without departing from the spirit and scope of the invention as hereinafter claimed.

What is claimed is:

1. A lock with a fastening cable comprising:

a locking unit (10) with a cable (101) having a passage (111) defined therein;

a key operated lock (20) received in said passage (111) and having a circular transmission block (23) engaged on said key operated lock (20);

a latch (30) connecting to said transmission block (23) of said key operated lock (20), said latch (30) including a first locking plate (31) and a second locking plate (32) each having a first end transferred by said transmission block (23), said first ends of said first and second locking plates (31; 32) respectively having first and second brackets (311; 321) extending outward therefrom, said first and second brackets (311; 321) being opposite to each other, and having a second end, said second ends of said first and second locking plates (31; 32) respectively forming first and second engagement hooks (312; 322) opposite to each other, said first engagement hook (312) and said first locking plate (31) being in a same plane, said second engagement hook (322) and said second locking plate (32) being in a same plane; said latch (30) further including a positioning plate (33) to hold said first and second locking plates (31; 32) in place; and a casing (40) mounted on said locking unit (10) to receive said latch (30) and said locking unit (10).

2. The lock with a fastening cable in accordance with claim 1, wherein said locking unit (10) includes a lock casing (11) and a cable adapter (12) fitting on said lock casing (11), said lock casing (11) having a locking hole (112) and a groove (114) defined therein, said lock casing (11) having a bottom formed of a plurality of threaded holes (115) allowing said casing (40) to be screwed thereon, said cable adapter (12) having multiple pinholes (122) defined therein and aligning with said groove (114) of said lock casing (11), each of said pinholes (122) having a pin (121) securely mounted therein and partially received in said groove (114) of said lock casing (11).

3. The lock with a fastening cable in accordance with claim 2, wherein said key operated lock (20) includes an eccentric shaft (21) extending therefrom and a blind hole (22) defined therein, said blind hole (22) aligning with said locking hole (112) of said lock casing (11), said locking hole (112) having a lock pin (113) securely mounted therein, said lock pin (113) extending through said locking hole (112) and partially received in said blind hole (22) of said key operated lock (20).

4. The lock with a fastening cable in accordance with claim 3, wherein said transmission block (23) includes a first side having an eccentric recess (231) defined therein to receive said eccentric shaft (21) of said key operated lock (20) and a second side having two stubs (232) extending therefrom, said two stubs (232) being on opposite ends of a diameter of said second side of said transmission block.

5. The lock with a fastening cable in accordance with claim 4, wherein said first and second brackets (311; 321) each have a recess (313; 323) to receive a corresponding stub (232) of said transmission block (23).

6. The lock with a fastening cable in accordance with claim 1, wherein said positioning plate (33) includes a slot (332) defined at a center to allow said first locking plate (31) and said second locking plate (32) extending therethrough, said positioning plate (33) including a first side having a recess (331) defined therein to allow said first-bracket (311) and said second bracket (321) to be moved therein and a second side.

7. The lock with a fastening cable in accordance with claim 2, wherein said positioning plate (33) includes multiple through holes (333) defined therein aligning with said threaded holes (115) in a face of said lock casing (11).

8. The lock with a fastening cable in accordance with claim 1, wherein said casing (40) includes a cavity (41) defined therein to receive said locking unit (10) and said latch (30), an inner flange (43) extends in from said casing (40) to form an opening (42) near the center of said casing (40), said inner flange (43) having multiple countersunk holes (44) defined therein to allow a bolt to extend through each hole (44) and a flange (45) extending from a bottom of said inner flange (43).

9. The lock with a fastening cable in accordance with claim 8 further comprising a spring (34) having one end abutting said second side of said positioning plate (33) and a second end abutting said flange (45) of said inner flange (43), said spring (34) allowing said first locking plate (31) and said second locking plate (32) to extend therethrough.

* * * * *

UNITED STATES PATENT AND TRADEMARK OFFICE

CERTIFICATE OF CORRECTION

PATENT NO. : 6,205,824 B1
DATED : March 27, 2001
INVENTOR(S) : Miao

It is certified that error appears in the above-identified patent and that said Letters Patent is hereby corrected as shown below:

Title page,
Below item [76] "Inventor", insert:

-- [73] Assignee: Jin Tay Industries Co., Ltd.
No. 486, Sec. 3, Ming Chih Rd.
Tai Shan Hsiang, Taipei Hsien
Taiwan, (TW) --

Signed and Sealed this

Twentieth Day of August, 2002

*Attest:*

*Attesting Officer*

JAMES E. ROGAN
*Director of the United States Patent and Trademark Office*